United States Patent [19]

Morrison

[11] 4,401,712

[45] Aug. 30, 1983

[54] ANTIMICROBIAL NON-WOVEN FABRIC

[75] Inventor: Willard L. Morrison, Winston-Salem, N.C.

[73] Assignee: Tultex Corporation, Winston-Salem, N.C.

[21] Appl. No.: 454,977

[22] Filed: Jan. 3, 1983

[51] Int. Cl.[3] ..... A61K 31/695; A01N 17/08

[52] U.S. Cl. ..... 428/289; 424/27; 424/28; 424/33; 428/907

[58] Field of Search ..... 428/289, 907; 424/27, 424/28, 33

[56] References Cited

U.S. PATENT DOCUMENTS 4,111,922 9/1978 Beede et al. ..... 424/27

*Primary Examiner*—James C. Cannon

*Attorney, Agent, or Firm*—Charles R. Rhodes; Judith G. Smith

[57] ABSTRACT

An antimicrobial agent is incorporated into the binder of a non-woven fabric where it resides in colloidal suspension within the amorphous zones of the polymer. Thus incorporated it migrates to the surface of the binder and onto the fibers of the non-woven fabric to inhibit the growth of bacteria and fungi.

3 Claims, No Drawings

ANTIMICROBIAL NON-WOVEN FABRIC

BACKGROUND OF THE INVENTION

The production of non-woven fabrics has increased in recent years as more and more uses of such fabrics have evolved. There are four basic processes for the production of non-woven fabrics including the "wet-laid" process, which is basically a paper making process in which the fibers making up the non-woven fabric are dispersed in water and formed into a sheet or web. After most of the water is removed, the fibers are bonded by the application of some type of binder (generally latex). In a second process, called the "drylaid" process, dry fibers are subjected to a carding operation which forms the fibers into a web, then some type of binder is applied to the web to hold the fibers together. The third process is the thermal bonding process in which "binder fibers" are used to form thermally bonded fibrous structures. Also, there is a needle punch process which is a mechanical bonding process in which the fibers are entangled by needles. It is the first two processes described hereinabove with which the present invention is concerned.

Non-woven fabrics are useful in the manufacture of such products as washing and wiping cloths, diapers, sanitary napkin covers, hospital gowns, sheets, pillow cases, curtains, and as backing materials for garments, table cloths, bed spreads and the like. Such products as diapers and sanitary napkin covers are intimately used in contact with the human skin. It is highly desirable that bacterial and fungal growth be controlled in such products. Therefore, if the diaper or cover can be itself made antibacterial or antifungal, its usefulness will be enhanced. Disposable products such as sheets, pillow cases, hospital gowns, wiping cloths, and curtains, are, for the most part, utilized in environments where the control of the growth of bacteria and fungi are always a desirable attribute for any product because of the likelihood of infection which can spread if bacteria and fungus growth is not severely controlled. Finally, the other main group of recited non-woven fabrics are utilized as backing materials for items that have long life, and the control of bacteria and fungus can enhance these products to a considerable degree.

It is, of course, well known to use topical antibacterial or antifungal agents which can be sprayed, rolled, or brushed onto fabrics; however, it is also known that as quickly as such topical treatments can be applied, they can be wiped off or lost through sublimation. It is also known to incorporate antibacterial and/or antifungal agents into special fibers to be made into garments or fabrics as is disclosed in U.S. Pat. Nos. 3,959,556 and 4,343,853. The economics of such specially spun fibers in non-woven fabrics is, however, highly questionable, especially in disposable products. Further, in non-woven fabrics there is disclosed in U.S. Pat. No. 4,111,922 to Beede et al the use of a quaternary ammonium agent which has antibacterial properties in the binder of a non-woven fabric being formed by the wet-laid process. However, this teaching is first of all limited to the wetlaid process because the particular binder taught by the Beede et al patent is too thick to be applicable to drylaid process. Most of the products listed hereinabove are formed by the drylaid process because of their superior hand characteristics. Further, the quaternary ammoniums of Beede et al are cross-linked with the polymers rather than being in suspension therein, so that there is no migration and replenishment of the surface once the initial deposit is removed. Thus, whatever antibacterial treatment is available is, like a topical treatment, quickly lost.

In the present invention, on the other hand, the antimicrobial agent is selected as to be compatible with either the wetlaid process or the drylaid process, can be used in any quantity and is effective as against both gram positive and gram negative bacteria. the antibacterial or antifungal agent of the present invention resides in colloidal suspension within the amorphous zones of the polymer rather than being cross-linked with the polymer so that a reservoir of antimicrobial agents is available to continuously replenish the surface should the initial deposits there be utilized. Since the agent is in suspension in the binder, it is free to migrate to the surface and onto the filbers of the non-woven fabric to more uniformly treat the fabric and therefore more completely inhibit the growth of bacteria and fungi.

An auxiliary benefit of the present invention lies in the fact that latex binders naturally tend to spoil and have a very short shelf life. The incorporation of the antibacterial or antifungal agent inhibits this natural tendency of the latex to spoil, and therefore materially increases the shelf life of the binder. Thus, the latex does not have to be formed in small batches immediately prior to the incorporation into the non-woven fabric, but can be made up in advance or at other locations and stored.

In general, the present invention is directed to a non-woven fabric in which a web of textile fibers, whether formed by the wetlaid process or the drylaid process has incorporated thereinto a polymeric base binding agent having suspended therein a selected antimicrobial agent. The agent resides in colloidal suspension within the amorphous zones of the binding agent so that it is available to migrate to the surface of the binder and onto the textile fibers both initially and subsequently.

In a preferred embodiment the agent is selected from a group containing the halogenated aromatic nitriles (such as tetrachloroisophthalonitrile, see U.S. Pat. Nos. 3,290,353 and 3,331,735); Fungaflor, a salt of imazalil sulphate and the proprietary product of Janssen Pharmaceuticals; 3,5,3′,4′-tetrachlorosalicylanilide (also known as Irgasan, a product of the Ciba-Geigy Co.); and hexachlorophene (2,2′-methylenebis-(3,4,6-trichloro) phenol, a product of the Givaudan Corp.). Such agents, when incorporated into the polymeric binder resin provide a superior result in both the wetlaid process and drylaid process for the manufacture of non-woven fabrics.

PREFERRED COMPOSITION

Non-woven fabrics as contemplated by the present invention utilize as the fibrous base such fibers as polyester, polypropylene, rayon, acrylics, blends of these synthetics or blends of these synthetics with natural fibers. Once the fiber is selected, a web of such fibers is first formed in a conventional manner, i.e. either by the wetlaid process, or by the drylaid process.

The binding agent is then prepared and applied to the web to bond the textile fibers together. In the preferred embodiment, the binding agent is a polymeric base material selected from the group of binding agents containing acrylic latexes, nitrile latexes, vinylchloride latexes, polyvinyl acetate, vinyl acetate-ethylenes, and styrene-butadine latexes. The binding agents described hereinabove are conventional and those listed are exemplary only, as the particular binder resin, apart from compatibility with the antimicrobial agent described below, is not the point of novelty. The above-named materials all exhibit compatibility with the variety of acceptable antimicrobial agents described below.

One of these polymeric base binding agents having been selected, the selected antimicrobial agent is added to the base resin, and the two are either melted together and mixed, or the agent is put into solution using a solvent which is compatible with the selected binder, then the agent and binder are mixed. The binding agent is then ready for application to the textile fabric web. Upon mixing, the antimicrobial agent becomes incorporated in colloidal suspension within the amorphous zones of the polymeric matrix. As such there is then formed a reservoir of the agent which becomes available to replenish the surface as supplies of the agent on the surface are removed. At such times the equilibrium of the system is disturbed and the internal vapor pressure causes a very small fraction of the agent to migrate providing a surface incretion. Proper migration ensures that the growth of bacteria or fungus is inhibited across the entire surface of the non-woven fabric. The presence of moisture on or near the surface of the non-woven fabric will even further enhance transfer of the antimicrobial agent as well as softening the cell wall of the fungus or bacteria to assist penetration of the agent through the cell wall, where the agent interferes with the metabolic function causing the death of the microbe.

The antimicrobial agent chosen for the composition must be one which is compatible with the binding agent employed in that it must be able to withstand the temperatures involved in the melting caring of the base resin. Further, the agent must be capable of becoming colloidally suspended within the amorphous zones of the polymer as described above. Antimicrobial agents which are known to be compatible with the variety of polymers contemplated are the halogenated aromatic nitriles (such as tetrachloroisophthalonitrile, see U.S. Pat. Nos. 3,290,353 and 3,331,735); Fungaflor, a salt of imazilil sulphate and the proprietary product of Janssen Pharmaceuticals; 3,5,3′,4′-tetrachlorosalicylanilide (also known as Irgasan, a product of the Ciba-Geigy Co.); and hexachlorophene (2,2′-methylenebis-(3,4,6-trichloro) phenol, a product of the Givaudan Corp.). Of these agents, applicant prefers tetrachloroisophthalonitrile and Fungaflor. Other antifungal and antibacteria agents not mentioned above, but having the same characteristics of suspension, may be utilized, but the above have been particularly effective when dispersed in polymeric compounds.

The 3,5,3′,4′-tetrachlorosalicylanilide sold under the trademark "Irgasan" demonstrates a high degree of activity and excellent performance over a broad spectrum of bacteria and fungi.

Any of the above antimicrobial agents may be used alone or in combination with each other as the active ingredient in the binder. The amount used is for the most part arbitrary, depending primarily on the requirements of the particular application and cost versus effective use-life. Preferred amounts range from approximately 0.05% to 1% by weight of the polymer base binding agent. The lesser amounts of active agent quite obviously will result in a shorter period of effectiveness. It is believed that antimicrobial agents in the amount of approximately twelve (12) grams per square yard of fabric is generally satisfactory for disposable products and will give them a satisfactory shelf life. On the other hand amounts in the range of thirty grams per square yard of fabric will be more appropriate for fabrics having a backing which are intended for washing and reuse.

The resulting fabrics have been shown to be effective against both gram positive and gram negative bacteria and accelerated tests show that this effectiveness lasts through the useful life of the fabric. As stated hereinabove, binding agents with the antimicrobial agent incorporated therein no longer have to be mixed immediately prior to incorporation into the fabric and curing, because the antimicrobial agent stablizes and prevents the natural tendency of the binding agent to spoil if not cured relatively quickly after mixing.

While the above antimicrobial agents have been named as preferred, it is obvious to those skilled in the art that others may also be employed within the scope of the present invention as claimed below.

What is claimed is:

1. A non-woven fabric comprising:

(a) a web of textile fibers formed according to the wetlaid process or the drylaid process;

(b) a polymeric base binding agent selected from the group containing acrylics, polyvinyl acetates, vinyl acetate-ethylenes, and styrene-butadine latexes; and (c) said binding agent having a minor amount of an antimicrobial agent incorporated therein, said antimicrobial agent being non-cross-linked with binding agent, residing in cooloidal suspension within the amorphous zones of said polymeric base binding agent available to migrate to the surface of the binding agent and onto the textile fibers until the internal reservoir is exhausted.

2. The non-woven fabric according to claim 1 wherein said agent is selected from the group consisting of compounds containing halogenated aromatic nitriles; a salt of imazalil sulphate; 3,5,3′,4′-tetrachlorosalicylanilide; and hexachlorophene.

3. The non-woven fabric according to claim 2 wherein said antimicrobial agent comprises a combination of two or more of said antimicrobial agents.

* * * * *